US006328172B2

(12) United States Patent
Alneng

(10) Patent No.: US 6,328,172 B2
(45) **Date of Patent: *Dec. 11, 2001**

(54) SHELVING STAND

(75) Inventor: Carl-Goran Alneng, Stockholm (SE)

(73) Assignee: Sintek International AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/747,855

(22) Filed: Dec. 22, 2000

Related U.S. Application Data

(63) Continuation of application No. 09/242,795, filed as application No. PCT/SE97/01114 on Jun. 23, 1997, now Pat. No. 6,196,400.

(30) Foreign Application Priority Data

Aug. 30, 1996 (SE) ..... 9603157

(51) Int. Cl.[7] ..... A47F 5/025; A47F 3/11

(52) U.S. Cl. ..... 211/144; 211/1.53; 211/131.1; 211/163

(58) Field of Search ..... 211/1.52, 1.53, 211/1.55, 1.56, 129.1, 131.1, 144, 163, 175

(56) References Cited

U.S. PATENT DOCUMENTS

| | | | | |
|---|---|---|---|---|
| 1,608,704 | | 11/1926 | McConaha . | |
| 1,653,323 | | 12/1927 | Taylor . | |
| 2,338,324 | | 1/1944 | Floyd . | |
| 3,565,263 | | 2/1971 | Wassell . | |
| 3,872,801 | | 3/1975 | Weddendorf . | |
| 4,072,887 | * | 2/1978 | Buschmann et al. | 318/675 |
| 4,736,856 | | 4/1988 | Alneng et al. . | |
| 4,938,549 | | 7/1990 | Potter . | |
| 4,939,962 | | 7/1990 | Wittkopp et al. . | |
| 6,072,766 | | 6/2000 | Konshak . | |
| 6,196,400 | * | 3/2001 | Alneng | 211/144 |

FOREIGN PATENT DOCUMENTS

| | | |
|---|---|---|
| 0 211 816 B1 | 7/1986 | (EP) . |
| 0 667 111 B1 | 9/1997 | (EP) . |
| 1.401.294 | 4/1965 | (FR) . |
| 1.552.245 | 11/1967 | (FR) . |
| 11708 | 10/1912 | (GB) . |
| 8503671-3 | 4/1987 | (SE) . |
| 8601061-8 | 2/1988 | (SE) . |

* cited by examiner

*Primary Examiner*—Alvin Chin-Shue
*Assistant Examiner*—Erica B. Harris
(74) *Attorney, Agent, or Firm*—Killworth, Gottman, Hagan & Schaeff LLP

(57) ABSTRACT

A shelf stand for goods is proposed which has individually rotatable shelves, which are substantially circular and located one above the other. At the periphery of each shelf there is a driving device adapted to cooperate with driving means on the peripheral part of the shelf for turning or rotating the shelf. The shelves are divided into sections provided with impulse generators cooperating with impulse counters for determining the rotational position of the shelf.

17 Claims, 13 Drawing Sheets

SHELVING STAND

CROSS-REFERENCE TO RELATED APPLICATION

This is a continuation application of application Ser. No. 09/242,795 filed on Feb. 23, 1998 now U.S. Pat. No. 6,196,400, by Carl-Göran Alneng, entitled SHELVING STAND, which is the U.S. national stage of PCT/SE97/01114, filed Jun. 23, 1997.

The present invention relates to a shelf stand having individually rotatable shelves located one above the other.

From the Swedish patents Nos. 8503671 and 8601061 it is known to provide shelf stands with vertical columns and a plurality of circular shelves carried by the columns and located on top of each other. It is also known from said patents to make the contents of these shelves readily accessible in the order of use first in-first out. The shelf stands can be made in various sizes and will obtain thereby various storing capacities.

In large shelf stands carrying heavy goods much power is consumed for starting the turning or rotation of a shelf, in spite of the fact that friction against the stationary shaft of the stand is minimized by means of ball bearings. When large shelf stands are used also more time is requested in the search for a particular product. It is desired that said search time be minimized, as a search in progress prevents other persons from searching on the same shelf at the same time.

The present invention has for its main object to eliminate the inconvenience when operating large shelf stands of the kind mentioned introductorily, so as to facilitate the search for a particular product and searching time thus be minimized.

Another object of the invention is to minimize the need for internal transports in shops, pharmacies, storage rooms and the like having computerized handling routines, where shelf stands of the said type are used.

According to the invention these and other objects and advantages are achieved by the invention obtaining the characeristic features defined in the accompanying claims.

The invention will be diclosed in greater detail in the following with reference to embodiments illustrated in the drawings:

FIG. 1 shows a side view of a shelf stand according to the invention;

FIG. 2*a* shows a plan view of a shelf of the stand shown in FIG. 1;

FIG. 2*b* shows a plan view of a shelf having extendable trays or cassettes;

Figure 1:
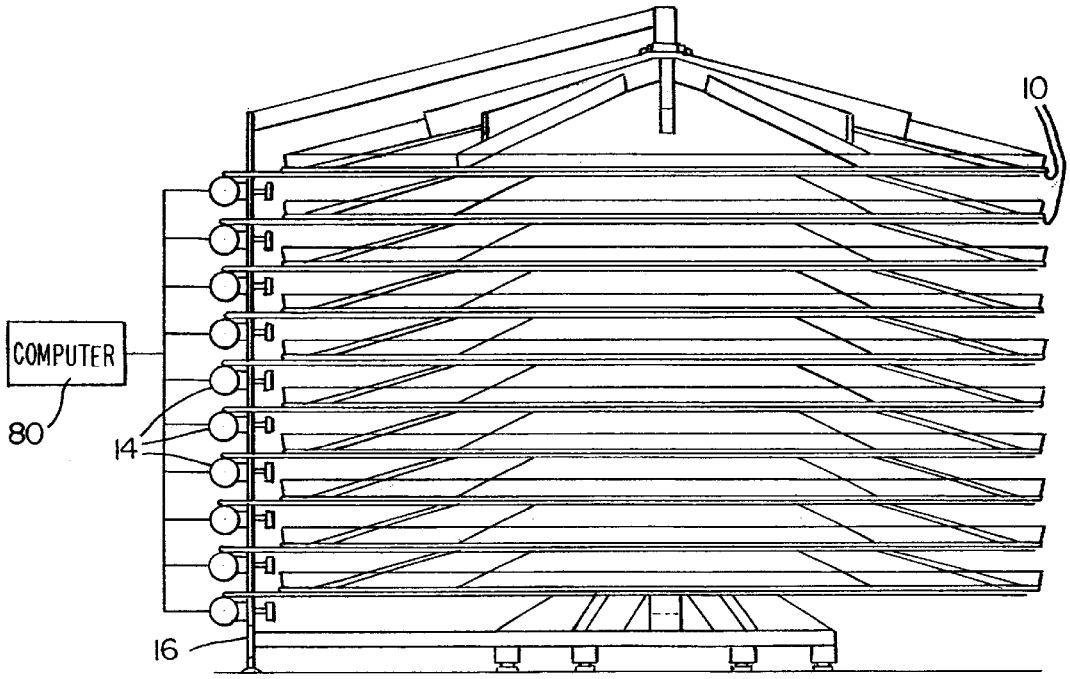
Figure 6A:
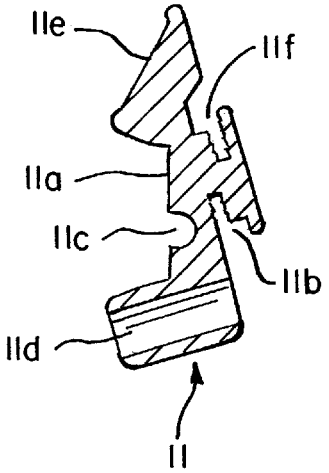
Figure 6B:
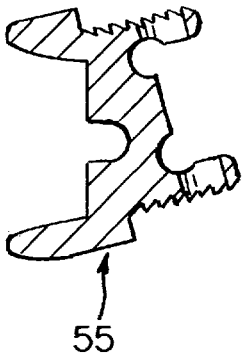
Figure 7:
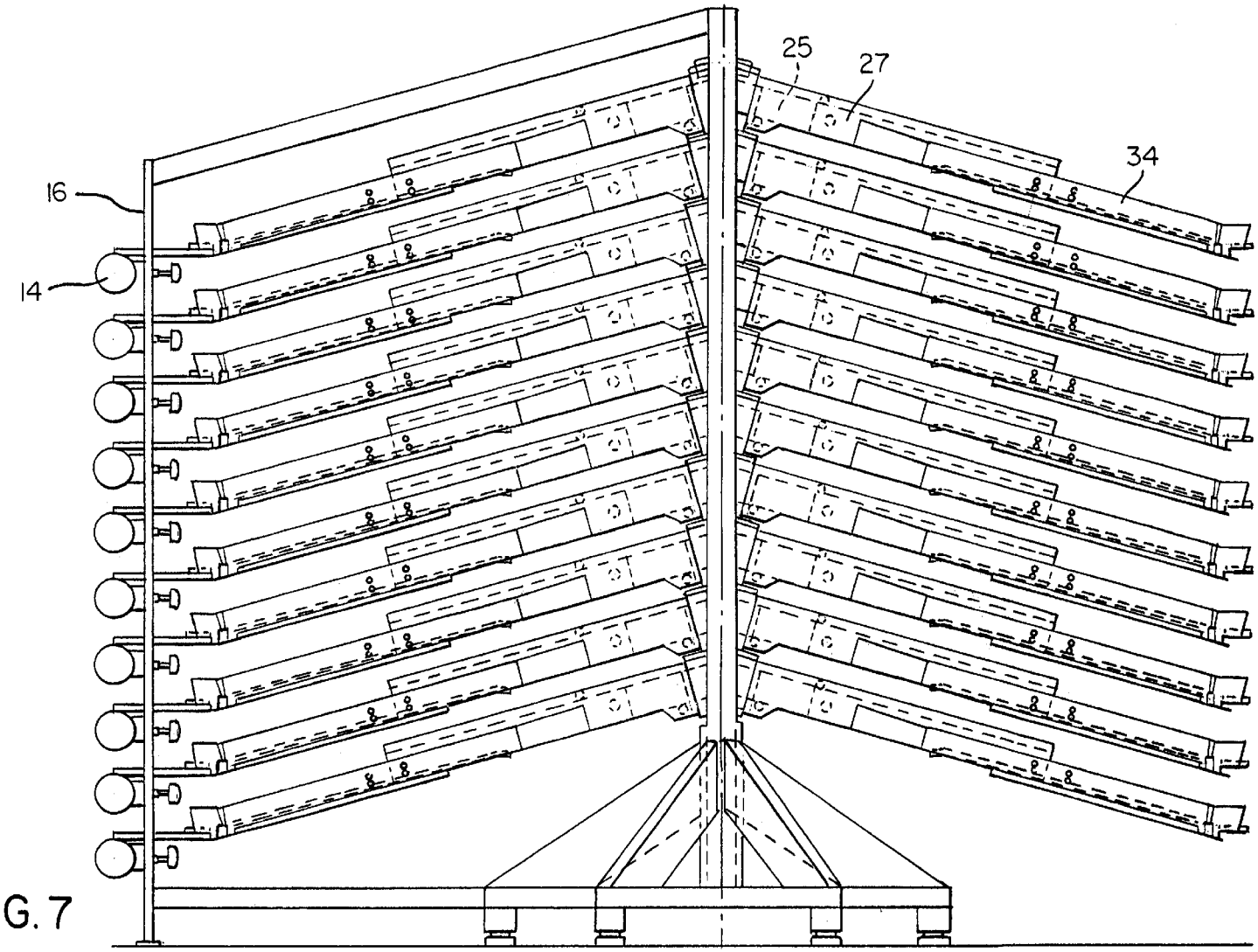
Figure 8:
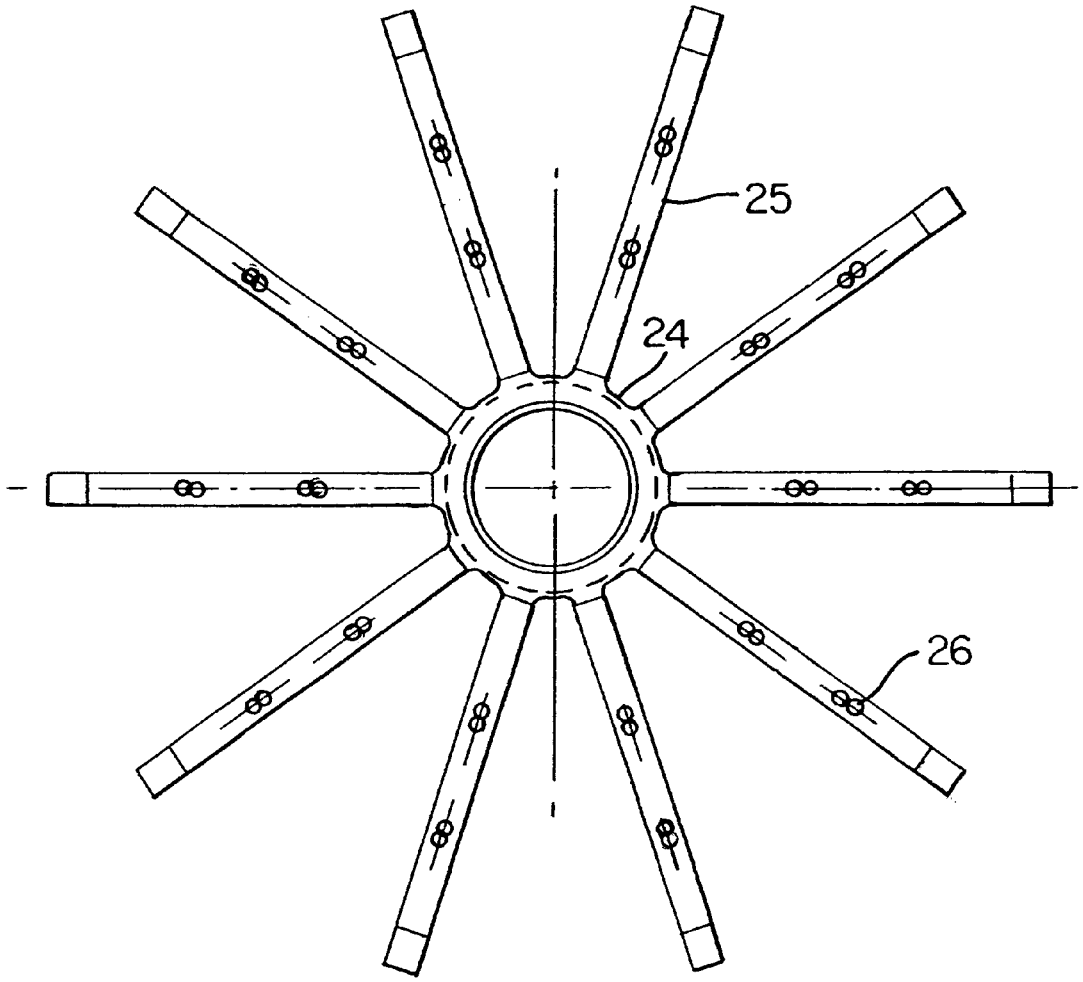
Figure 9A:
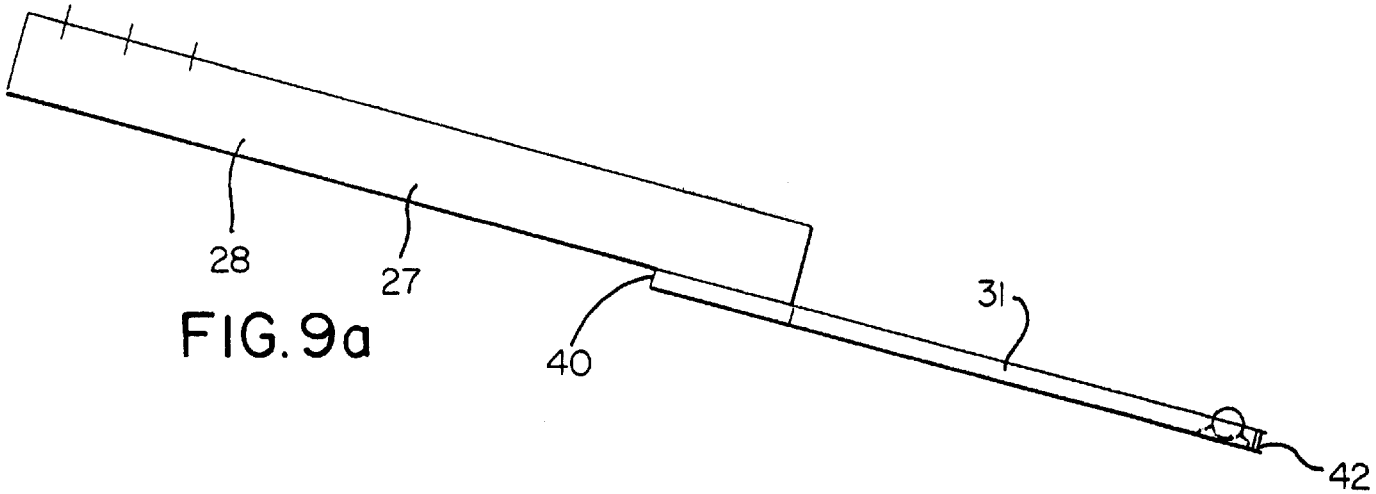
Figure 9B:
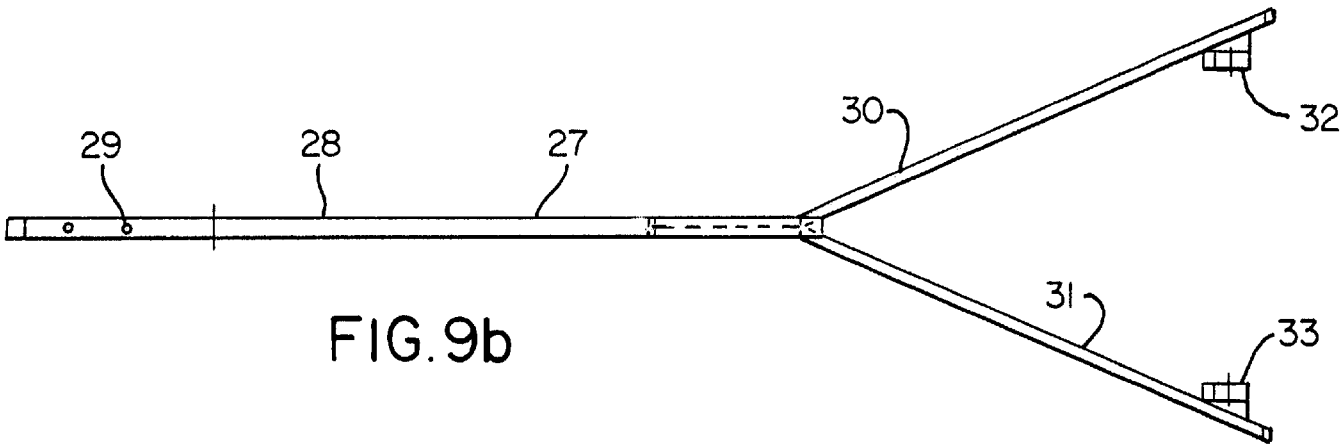
Figures 10A, 10B:
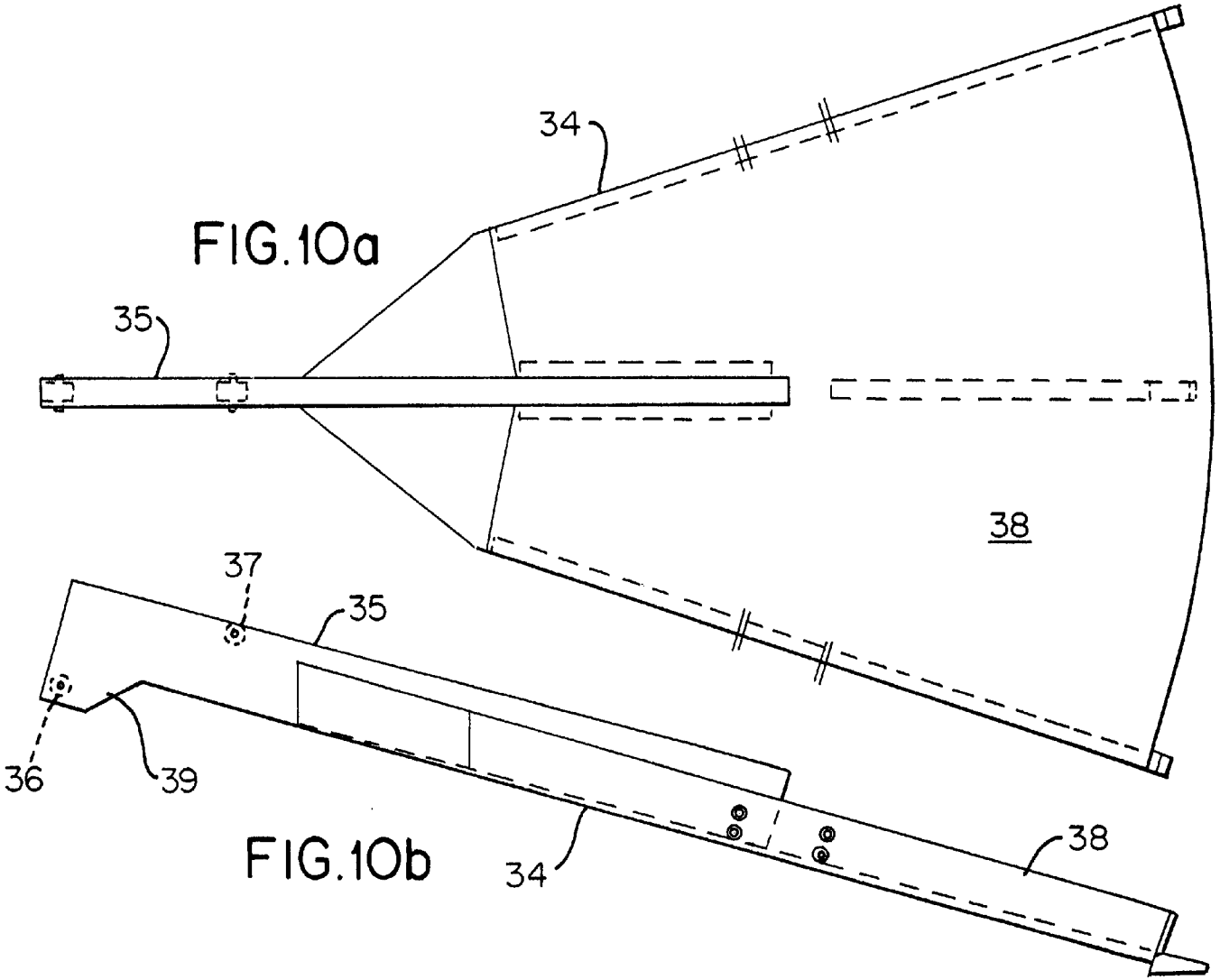

FIG. 6*a* shows a detailed view of an embodiment of a profilated section;

FIG. 6*b* shows another embodiment of said section:

FIG. 7 shows a side view, similar to FIG. 1, of a further embodiment of a shelf stand having extendable cassettes;

FIG. 8 shows a plan view of a spider for carrying a shelf in the shelf stand of FIG. 7;

FIGS. 9*a* and 9*b* show a side view and a plan view, respectively, of a bracket to be suspended on the spider of FIG. 8;

FIGS. 10*a* and 10*b* show a plan view and a side view, respectively, of a cassette, or tray, for mounting on the bracket of FIGS. 9*a* and 9*b;*

Figure 2A:
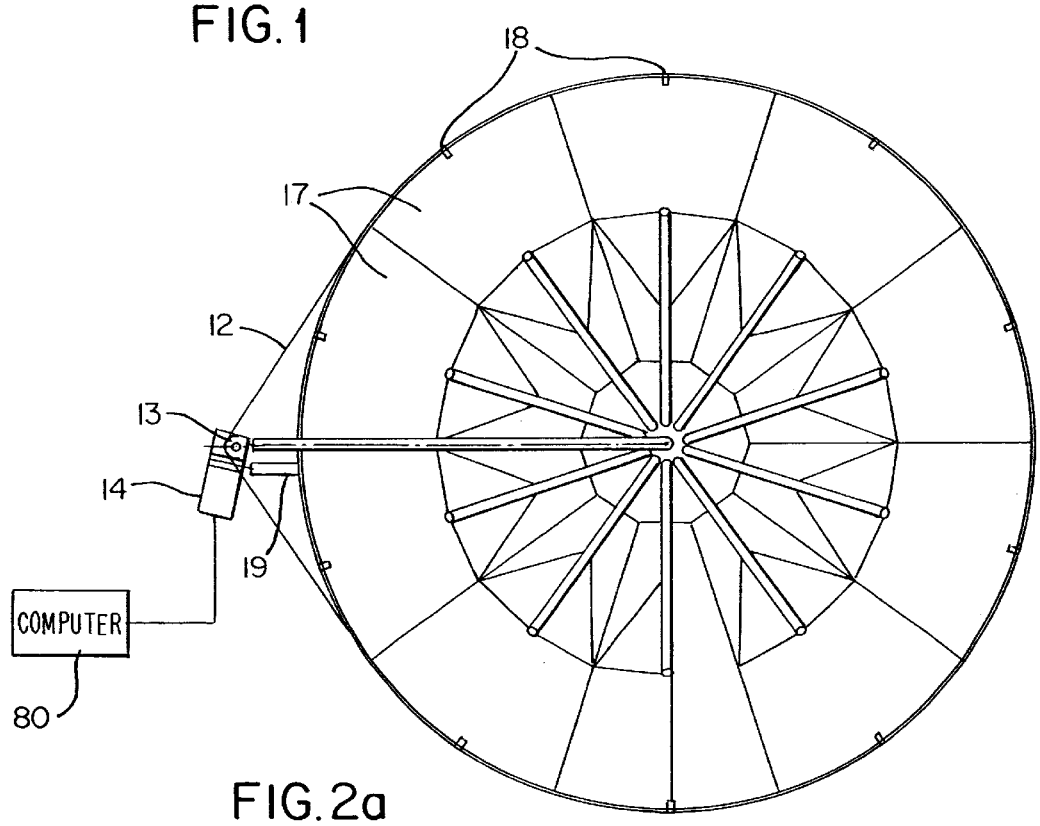
Figure 2B:
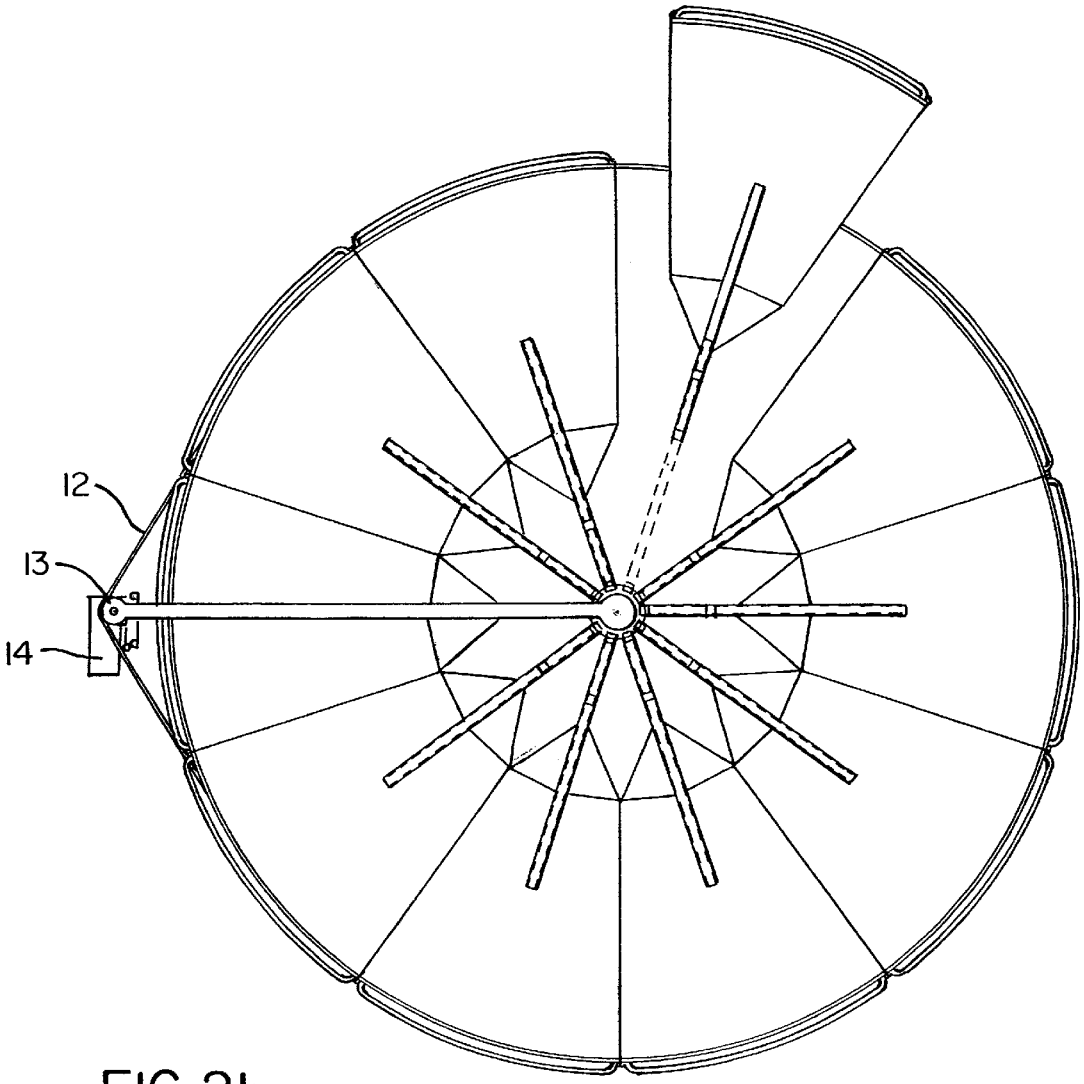
Figure 11A:
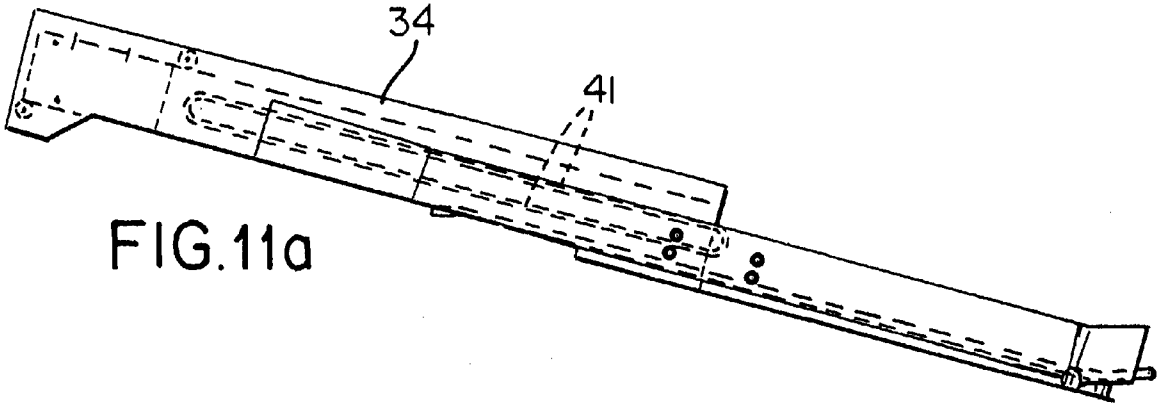
Figure 11B:
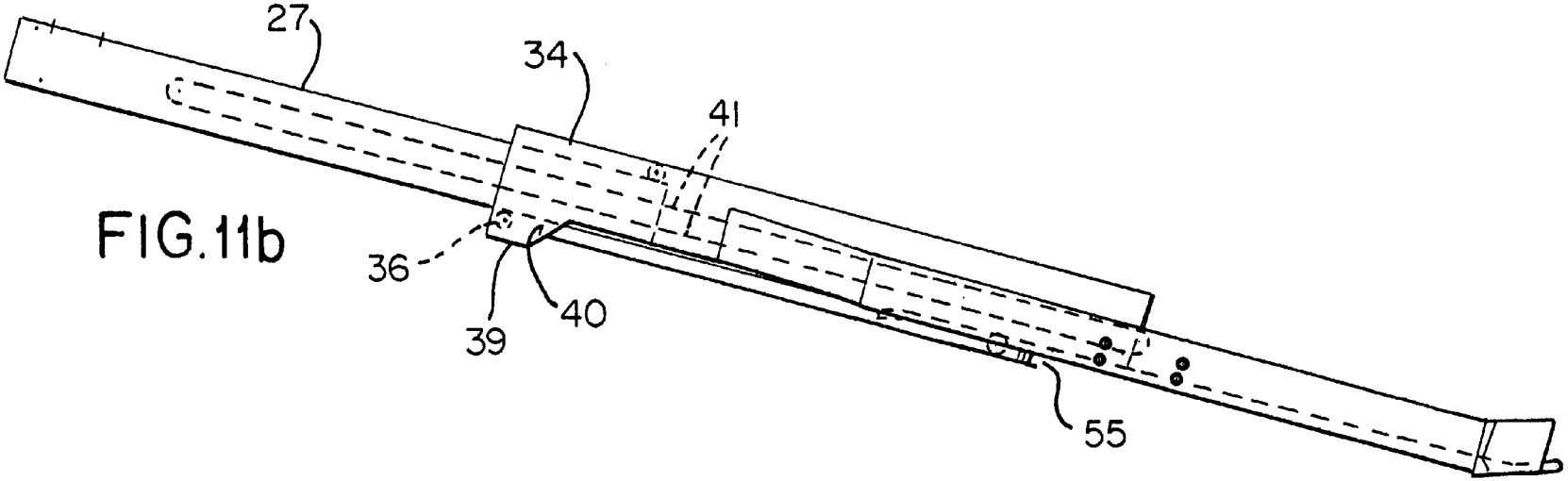
Figure 12:
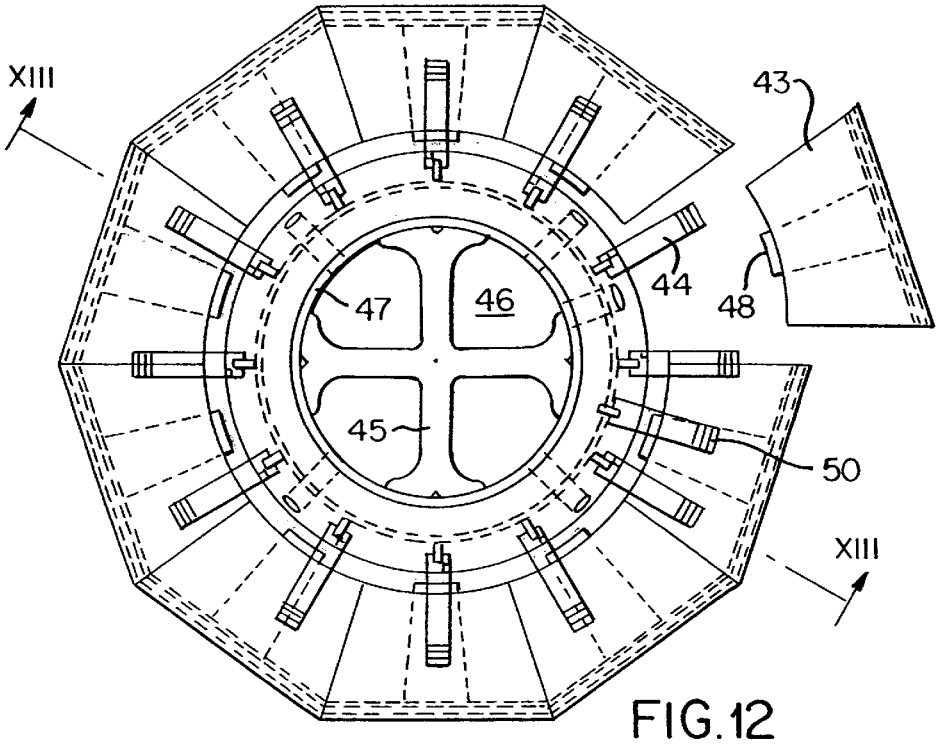
Figure 13:
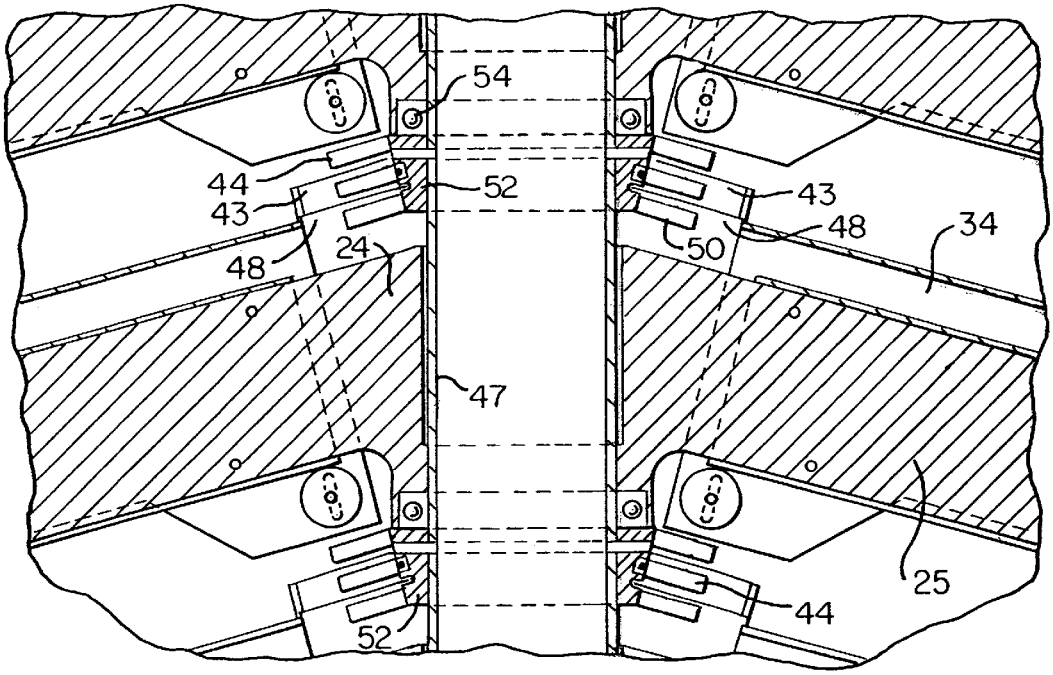
Figure 14:
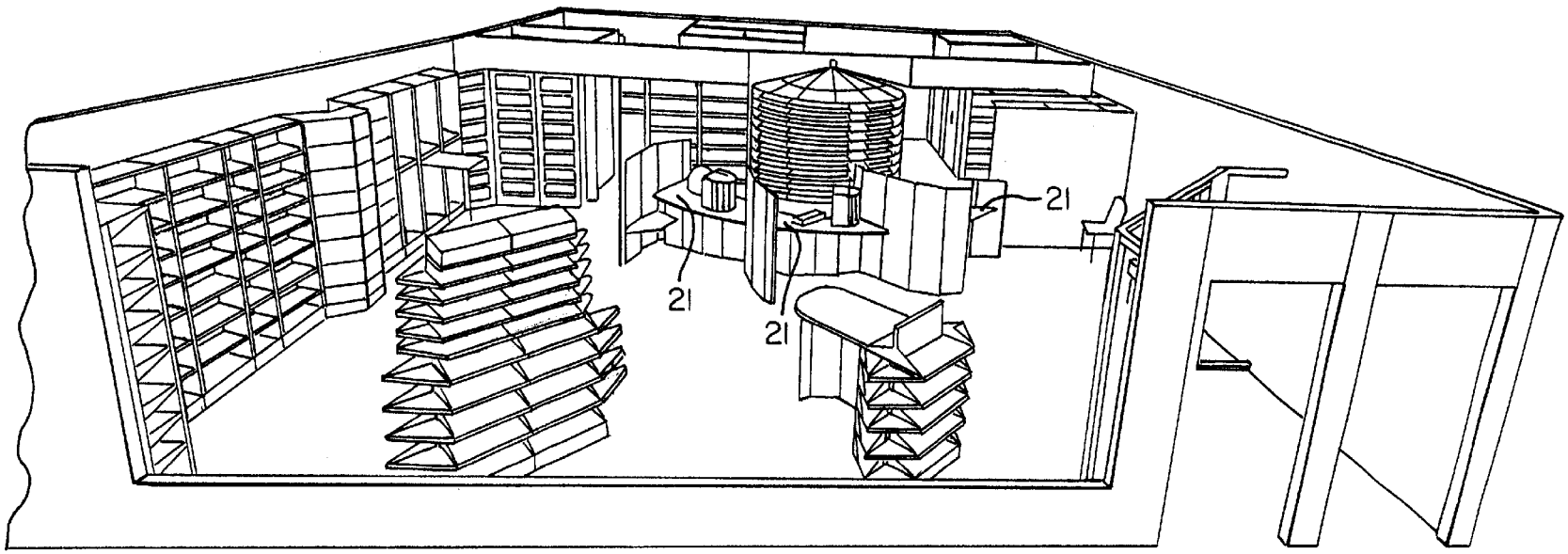
Figure 15:
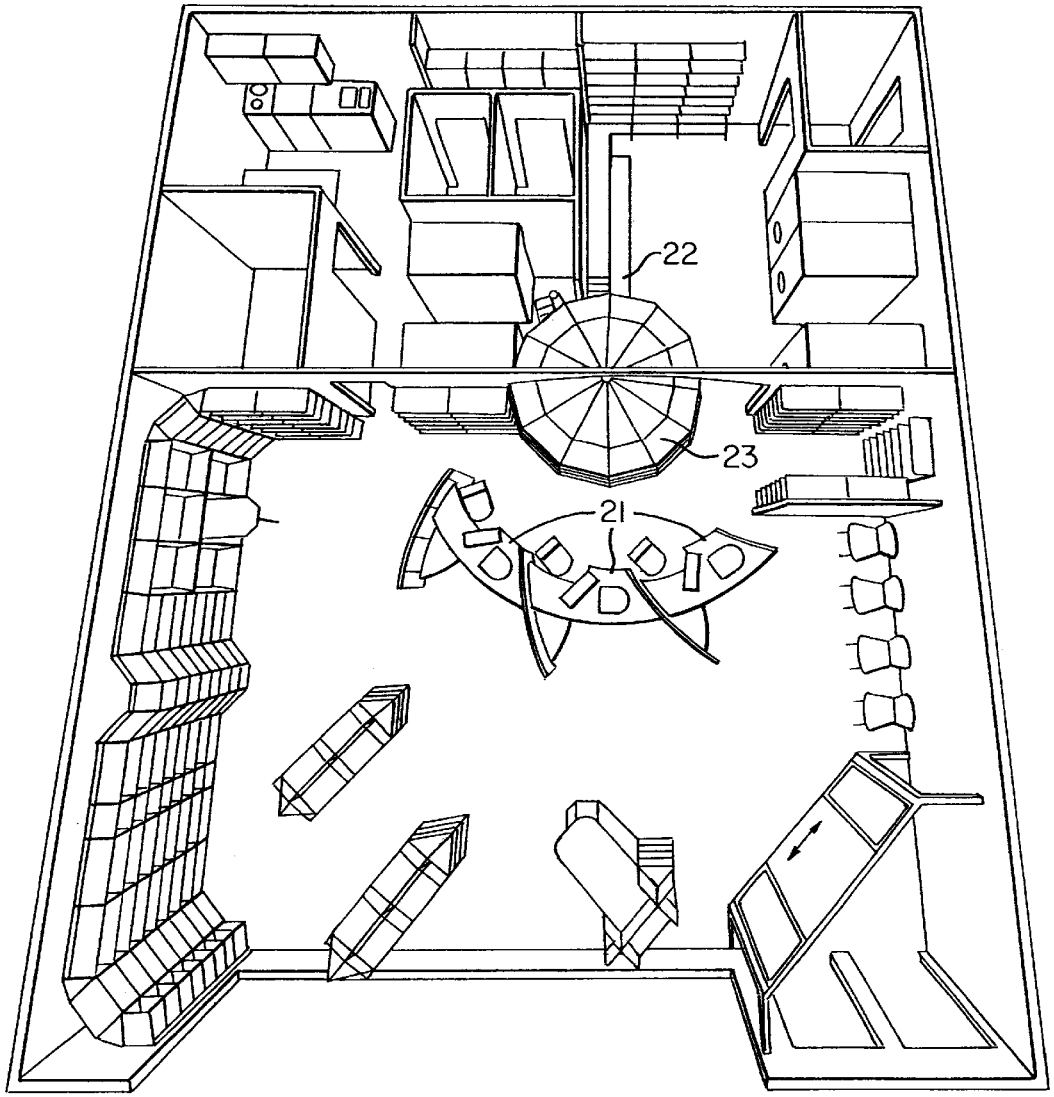

FIGS. 11*a* and 11*b* show sideviews of the cassette of FIGS. 10*a* and 10*b* mounted on the bracket of FIGS. 9*a* and 9*b,* in retracted and extended position, respectively;

FIG. 12 shows a cross section through the central portion of the shelf and its shaft, with impulse generators and receivers for extendable cassettes such as shown in FIGS. 2*b* and 11;

FIG. 13 shows, on a larger scale, a part of a longitudinal section along line XIII—XIII in FIG. 12 through the central part of the shelf stand and its shaft;

FIG. 14 shows a shelf stand according to the invention introduced into a sales room, such as a pharmacy; and FIG. 15 shows a lay-out of a sales room having a shelf stand according to the invention.

The present invention thus relates to a shelf stand of the type disclosed in the patents mentioned above and includes a number of rotatable shelves 10, preferably circular, and situated one above the other, as illustrated in FIG. 1. Each shelf 10 is then provided at its periphery with a profilated section 11 shown in FIG. 6*a* and described in greater detail below, wherein a driving belt 12 is engaged, surrounding and running about shelf 10 and a driving gear 13 driven by a motor 14, such as an electric motor. Driving belt 12 can be e.g. a so called indented belt whereas the driven wheel, which is formed by shelf 10 itself and its curved circumferential section 11, need not be provided with teeth thanks to its large circumference in relation to that of the driving gear. The vast frictional surface suffices for allowing the two wheels to interact without driving belt 12 slipping on section 11.

The profilated section or rib 11, a cross section of which is shown in FIG. 6*a,* has a recess 11*a* for accommodating driving belt 12 and is preferably divided, for example, in four parts, provided along the periphery of shelf 10 to form together a wheel rim on the circular shelf. The rib has an attachment 11*b* by means of which it can be hooked on to shelf 10. For holding the rib together there is provided, in the bottom of said driving belt recess, a depression 11*c,* wherein a wire or similar tensioning means (not shown) can be located for pulling and holding together the rib by means of an appropriate wire tightener or wire joint. At its lower part rib or section 11 is provided with a bore 11*d* in predetermined positions along the periphery of shelf 10 for accommodating an impulse generator 18, described in greater detail below, for determining the rotational position of shelf 10. Rib 11 is provided at its top with a label holder 11*e*. In a gripper 11*f* edge flanges or walls can be secured for maintaining the goods on shelves 10 while they rotate. FIG. 6*b* illustrates another embodiment 55 of such a rib for a wheel-forming shelf having extendable cassettes according to FIGS. 11*a,* 11*b* and 2*b*.

Figure 3:
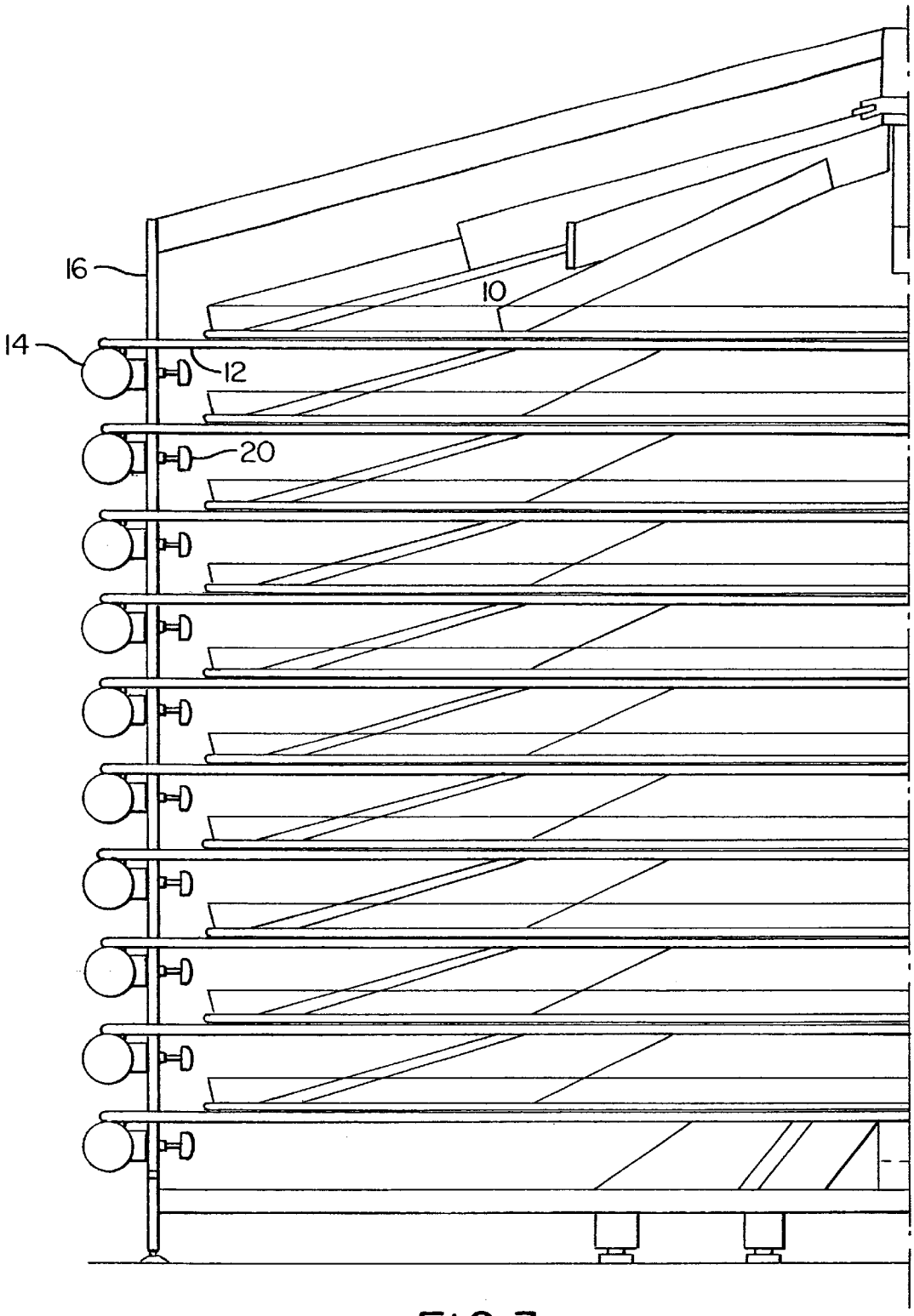
FIG. 3 shows, on a larger scale, a side view of a part of the shelf stand of FIG. 1.
Figure 4:
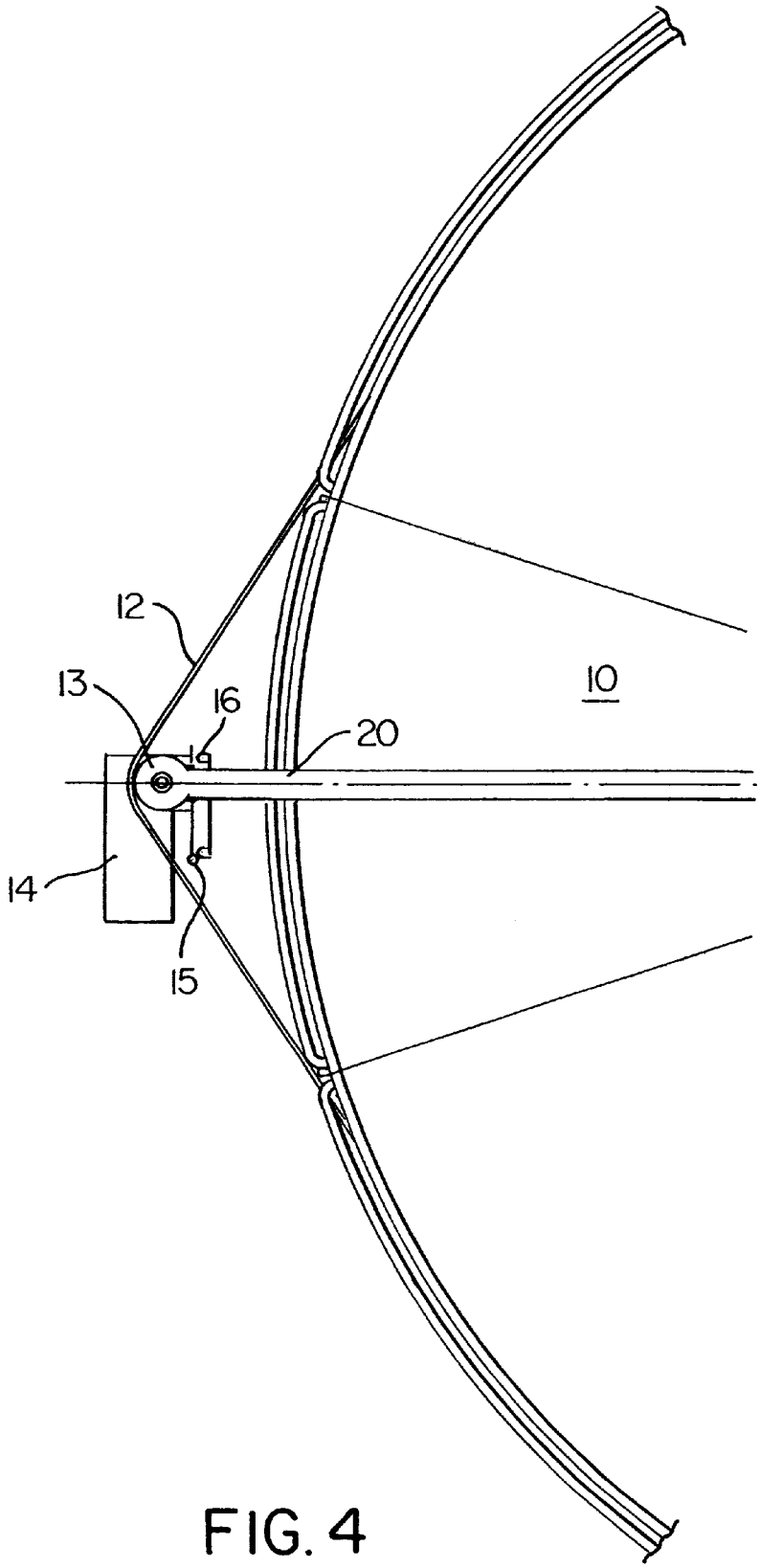
FIG. 4 shows, on a larger scale, a plan view of a drive unit for a shelf of the stand.
Figure 5:
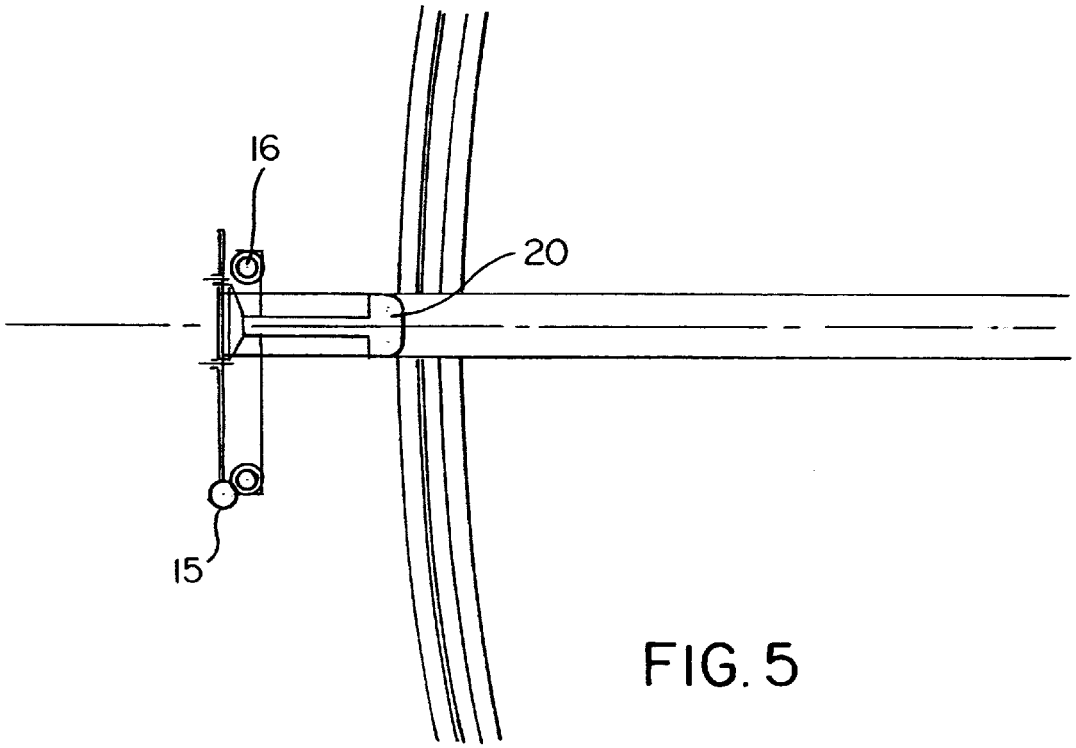
FIG. 5 shows, likewise on a larger scale, a plan view of the suspension device for the drive unit of FIG. 4.

Each circular shelf 10 is driven individually by its own motor 14, as shown in FIGS. 1, 2*a,* 2*b* and 3. The speed and direction of rotation of motors 14 are preferably variable. Each motor 14 is suspended on vertical hinge-like supports 15, see FIGS. 4 and 5, in turn suspended by a vertical stand or motor column 16, on which the motors are mounted one above the other, spaced the same distance as shelves 10, as shown in FIGS. 1 and 3. At its top end motor column 16 is rigidly connected with the center shaft of the shelf stand and at its lower part likewise connected with the foot of the stand. Each hinge-like support 15 can be manipulated by means of an adjustment screw 20 threaded in column 16, the screw engaging a pressure plate carried in motor support 15. By screwing in adjustment screw 20 hinge-like support 15 is tilted outwards from shelf 10 so as to increase the distance between each shelf and driving gear 13 of its motor, thus tensioning driving belt 12. Thus correct tension of said belt can be set to fit each motor driven shelf.

Each shelf 10, which is preferably circular, is divided into an appropriate number of sector shaped panels, shelf sectors 17, which are provided with an identification code, e.g. a number. As shown in FIG. 2*a,* a plan view of the shelf stand, shelf 10 is e.g. designed to include ten shelf sectors. Each such sector 17 is provided on its perimeter with an impulse generator 18 in the form of a magnet or the like, which cooperates with an impulse counter 19 in order to determine the position of shelf 10 in relationship to a fixed point on the shelf stand, e.g. on motor column 16. Singling out shelves 10 deciding start, direction of rotation and speed of the motors is controlled e.g. by a computer 80, preferably the same computer used for other administrative areas of the general service operation. The shelf stand can also be provided with its own computer 80, having the limited capacity required for control of its shelf operations. The starting position of shelf 10 and the position of the desired shelf sector 17 are both controlled by impulse counter 19. The shelf stand is preferably operated on the basis of the article number of the product sought for, the number being registered in the computer at one or more dispensing points, and registration can also be made from the point of replenishing. All these working stations are arranged in association with the periphery of the shelf stand, as will be described below.

In FIG. 7 is shown, in side view, another embodiment of the shelf stand according to the invention. In this shelf stand the shelves are sloping and include extendable cassettes 34 which are slidable on brackets 27, which in turn are secured to a shelf spider, described more closely below. Other parts, which are the same as in the shelf stand according to FIGS. 1–3, such as motors etc., have been provided with the same reference characters.

In FIG. 8 the basic framework or spider for the shelves is shown, said spider including a hub 24 and a plurality of spokes 25 corresponding to the number of shelf sectors 17, ten in the illustrated case. Each spoke 25 has apertures 26 for securing a Y-shaped bracket 27, shown in FIGS. 9*a* and 9*b*. Bracket 27 comprises a web 28 of square tube material provided with apertures 29 for mounting a bracket on each spoke 25 by means of apertures 26 therein. From web 28 of the bracket two shanks 30, 31 extend, which are provided at their outer ends with two upwardly facing wheels 32, 33 for carrying an extendable cassette or tray on the bracket. Cassette 34, shown in FIGS. 10*a* and 10*b,* includes a U-section 35 open downwards and is intended to be mounted straddling web 28 of the Y-bracket, in doing which a support roller 36, see below, is dismounted momentarily. In order that U-section 35 of the cassette does not tip in relation to bracket 27 and also that it will run readily on the bracket, two support rollers 36 and 37 are provided for rolling on the underside and top side, respectively, of web 28 of Y-bracket 27. A box-shaped storage tray 38 is secured to cassette 34 and its U-section 35, the form of the tray corresponding to the form of a sector 17 of the shelf stand. Upon assembling cassette 34 and Y-bracket 27, support rollers 36, 37 will roll on web 28 of bracket 27, while the cassette tray 38 rests by its underside on bracket wheels 32, 33. Cassette 34 will then be extendable from a retracted position, shown in FIG. 11*a* where its rear end coincides with the rear end of bracket 27, to a position wherein it projects from the shelf stand, as shown in FIG. 11*b*. The pulling out of cassette 34 in relationship to bracket 27 will then be arrested by support roller 36 striking the apex end 40 of bracket shanks 30, 31. Said shanks are provided at their outer ends with lugs 42 for attaching a profilated section 55 shown in FIG. 6*b,* such section replacing section 11, described earlier and shown in FIG. 6*a,* for accomodating driving belt 12 which sets each shelf in rotation. Between bracket 27 and cassette 34 a braking or damping device 41 can be introduced, which dampens the outwardly directed movement of cassette 34 and assists in pushing it in to its retracted position. Braking device 41, which can also be provided with e.g. tension and compression springs, is shown in FIGS. 11*a* and 11*b* in a design where a rubber cable sling is secured at one end within web 28 of the bracket and at its opposite end to U-web 35 of the cassette.

As is apparent from FIGS. 12 and 13 each cassette 34 has an impulse generator 43 at its rear guiding members, cooperating without friction with a stationary impulse receiver 44 on the rotational shaft of the shelf stand, to indicate whether the cassette is in its retracted or extended position. The number of impulse receivers 44, twelve here, is then larger than the number of sectors or cassettes, which is ten, to exclude the possibility that an impulse receiver 44 becomes ineffective while landing at a joint between two sectors. By means of another impulse generator 48, cooperating without friction with another impulse receiver 50, also the position of cassette 44 in the direction of rotation of shelf 10 can be indicated. This arrangement is substituted for the impulse generators 18 of FIG. 2 mounted on the periphery of shelves 10. As can be seen from FIG. 12 the rotating shaft 45 of the shelves comprises a metal channel section having channels 46 for leading cables to and from the motors and the impulse receivers or counters. Said shaft 45 is then provided with a surrounding, rigidly mounted tube shaft 47 having a retaining ring 52 for coacting with the ball bearings 54 and hub 24 of the shelves.

As mentioned in the aforegoing, selecting shelves 10, start/stop of the motors and their direction of rotation and speed can be controlled by a computer. The position of the shelves and the position of each shelf sector is controlled in both cases by means of the impulse counters. As to the extendable cassettes 34, whether any one cassette is extended or retracted is checked by means of impulse generators 43 and impulse receivers 44, to the effect that rotation of shelves 10 cannot commence when a cassette has been pulled out.

As mentioned above the shelf stand is preferably operated at one or more dispense stations and also remotely, from the station where replenishing is carried out, preferably by registering in the computer the article number of any item sought for. All said working stations are arranged in association with the periphery of the shelf stand.

Replenishing goods at the goods reception point is carried out such that the article number of each item is registered together with the number of the shelf sector 17 where the item is placed, which should be carried out in alphabetical order so that manual routines can be resorted to at service interruptions, as other so called picking machines or automatic storing facilities will be completely knocked out when electric or computer systems break down. The registration of the position of the goods will guide the automatic search process.

Dispensing is carried out such that the article number of the item sought for is entered in the ordinary dispense procedure. An extra search impulse starts the search process in the shelf stand: selection of shelf 10, selection of shortest route and most favourable direction of rotation, selection of rotational speed—which should be higher when the distance between the starting point and the self sector 17 is great—and selection of the proper shelf sector 17, which is then moved forward towards the sales person.

In FIGS. 14 and 15 a perfect siting of the shelf stand according to the present invention is shown. In the lay-out drawing according to FIG. 15 it is shown how half of the shelf stand, e.g. in a pharmacy, extends through a wall in the premises and the remaining part 23, i.e. two quarters of the stand, are found in a goods reception room 22 and a secondary space, respectively. There are three working stations 21 for servicing the customers. The shelf stand is placed such that the motors are located in the secondary space behind a so called rolling store. This renders service possible while removing accident hazards. Transports from the reception room 22 are eliminated, as the rotating shelves 10 take care of moving the goods.

When dispensing and picking from a shelf 10 is going on, other dispensing operations requested from this shelf are placed in queue order. As soon as the first dispense operation has been completed by a "release" impulse, shelf 10 will rotate forward to the next, newly requested position. There will be an essential gain of time when the shelf stand is advancing the proper shelf sector 17 at the same time as a service person carries out his or hers complete registry program while in contact with the customer.

It is apparent from the above description that shelf stands with rotatable shelves 10, further developed as taught by the invention, bring about great rationalization profits in the form of time and comfort. The lay-out described above, which was made possible by the developed shelf stand, has the effect that the need for extra handling and internal transports of goods stored in the shelf stand is reduced.

It is obvious that the embodiment of the shelf stand according to the invention, as shown and disclosed here, only exemplifies how the invention can be carried into effect and that the inventive concept can be altered and modified within the scope of the accompanying claims.

What is claimed is:

1. A shelf stand for goods comprising:

a plurality of individually rotatable shelves situated one above the other, each of said shelves having a plurality of sectors and being substantially circular in shape;

each shelf having a rib provided along the periphery thereof;

a plurality of impulse generators positioned one each, on said plurality of sectors;

a plurality of stationary impulse counters, each impulse counter arranged to communicate with each of said impulse generators along an associated one of said shelves to determine the rotational position of said associated one of said shelves;

a plurality of driving devices, each of said driving devices positioned adjacent to the periphery of a respective one of said plurality of individually rotatable shelves, each of said driving devices having a driving gear; and, a plurality of driving belts, each driving belt engaged with the driving gear of an associated one of said plurality of driving devices and extending around the shelf adjacent to said associated one of said plurality of driving devices in cooperation with said rib.

2. A shelf stand according to claim 1, further comprising a vertical framework rigidly connected between a central shaft of said shelf stand and a foot of said shelf stand, wherein each of said plurality of driving devices includes an electrical motor adjustably mounted on said vertical framework.

3. A shelf stand according to claim 2, wherein each motor is carried on a hinge-like support on said framework, an adjustment screw mounted therein and engaging said hinge-like support in order to tilt said hinge-like support horizontally relative to said framework, whereby the tension of said driving belt is adjusted.

4. A shelf stand according to claim 1, wherein the plurality of sectors of the shelves include extensible cassettes carried by support means including a hub with spokes upon which spoke engaging brackets, substantially Y-shaped, are arranged, said spoke engaging brackets having wheels on their top side for cooperating with the underside of the extensible cassettes.

5. A shelf stand according to claim 4, wherein a braking device is provided between each bracket and cassette, said device braking the movement outwards of the cassette and assisting in retraction of the same.

6. A shelf stand according to claim 4, wherein said spoke engaging brackets have at their outer ends attachment means for a circular metal section forming a wheel rim of the shelf.

7. A shelf stand according to claim 6, wherein the metal section has a recess for coacting with the driving belt and a depression for a wire stabilizing the wheel rim by means of a tensioning device, the metal sections having on their opposite side attachments for the brackets.

8. A shelf according to claim 4, wherein the extendible cassettes have at their rear ends impulse generators cooperating with impulse counters to indicate whether a cassette is in a retracted or extended position.

9. A shelf stand according to claim 8, wherein a selected one of said shelves cannot rotate when any one of said extensible cassettes associated with said selected one of said shelves is in said extended position.

10. A shelf stand according to claim 1, wherein the stand is connected with a computer, said computer adapted to single out one of the shelves whose motor is brought to select for the shelf the proper running direction, the proper speed and the shortest distance from any starting position to a selected rotational position.

11. A shelf stand according to claim 1, wherein a remotely positioned computer is adapted to control said plurality of driving devices.

12. A shelf stand according to claim 1, wherein each impulse counter is arranged to communicate with each of said impulse generators along an associated one of said shelves to determine the position of said associated one of said shelves in relationship to a fixed point on said shelf stand.

13. A shelf stand according to claim 1, wherein each impulse counter is arranged to communicate with each of said impulse generators along an associated one of said shelves to determine the position of said associated one of said shelves in relationship to a motor column, said motor column rigidly connected to said shelf stand.

14. A shelf stand according to claim 1, wherein each impulse counter is arranged to communicate with each of said impulse generators along an associated one of said shelves to control a start position and the rotational position of said associated one of said shelves.

15. A shelf stand according to claim 1, wherein each impulse counter is arranged to communicate with each of said impulse generators along an associated one of said shelves, and a computer to control a start position and the rotational position of said associated one of said shelves.

16. A shelf stand according to claim 1, wherein a computer is arranged to control the start, stop, and direction of each of said shelves individually, and the rotational position of each said shelf is controlled by said impulse counters.

17. A shelf stand for goods comprising:

a plurality of individually rotatable shelves situated one above the other, each of said shelves having a plurality of sectors and being substantially circular in shape;

each shelf having a rib provided along the periphery thereof;

a plurality of impulse generators positioned one each, on said plurality of sectors;

a plurality of stationary impulse counters, each impulse counter arranged to communicate with each of said impulse generators along an associated one of said shelves to control the rotational position of said associated one of said shelves;

a plurality of driving devices, each of said driving devices positioned adjacent to the periphery of a respective one of said plurality of individually rotatable shelves, each of said driving devices having a driving gear; and, a plurality of driving belts, each driving belt engaged with the driving gear of an associated one of said plurality of driving devices and extending around the shelf adjacent to said associated one of said plurality of driving devices in cooperation with said rib.

* * * * *